US007735243B1

(12) United States Patent
Gilkey et al.

(10) Patent No.: US 7,735,243 B1
(45) Date of Patent: Jun. 15, 2010

(54) FOOTWEAR TOE PAD

(76) Inventors: Rebecca A. Gilkey, 736 Delaware Trail, Mercer, PA (US) 16137; Robert R. Gilkey, 736 Delaware Trail, Mercer, PA (US) 16137

( * ) Notice: Subject to any disclaimer, the term of this patent is extended or adjusted under 35 U.S.C. 154(b) by 385 days.

(21) Appl. No.: 11/825,623

(22) Filed: Jul. 9, 2007

(51) Int. Cl.
*A43B 3/12* (2006.01)
*A43B 7/26* (2006.01)

(52) U.S. Cl. ..... 36/94; 36/11.5

(58) Field of Classification Search ..... 36/50.1, 36/51–53, 114, 89–92, 170, 45, 94, 93, 11.5; D2/916; 602/30
See application file for complete search history.

(56) References Cited

U.S. PATENT DOCUMENTS 736,194 A * 8/1903 Bassett ..... 36/11.5
3,978,596 A * 9/1976 Brown et al. ..... 36/11.5
6,298,580 B1 10/2001 Tadayon
6,381,755 B2 5/2002 Cortani
6,393,620 B2 5/2002 Hatch et al.
6,881,196 B2 * 4/2005 Crunkleton ..... 602/5
7,335,178 B2 * 2/2008 Berger et al. ..... 602/30
2002/0121030 A1 * 9/2002 Coleman ..... 36/11.5
2002/0121031 A1 9/2002 Coleman
2005/0198870 A1 * 9/2005 Berger et al. ..... 36/94
2006/0254085 A1 11/2006 Mollicone
2008/0301977 A1 * 12/2008 Roberts et al. ..... 36/94

* cited by examiner

*Primary Examiner*—Jila M Mohandesi
(74) *Attorney, Agent, or Firm*—Harpman & Harpman

(57) ABSTRACT

A self-adhesive toe pad for open toe sandals and the like that have a thong strap that is engaged between the big toe and pointer toe. The toe pad is of a contoured flat base with a curvilinear upstanding strap engagement portion that is of a dimensional thickness that pads the toe contact areas for improved comfort during use.

4 Claims, 2 Drawing Sheets

FOOTWEAR TOE PAD

BACKGROUND OF THE INVENTION

1. Technical Field

This invention relates to shoes, especially sandals and insert devices such as pads that are used to increase wearability of the shoe by providing for applied pads and cushions to enhance the comfort of the user.

2. Description of Prior Art

Prior art devices have been directed to shoe and sandal accessories that can be applied to the user's foot or directly to the shoe to benefit the user in comfort and use characteristics. Such prior art devices have relied on a variety of different designs to address different shoe and sandal wearing issues, see for example U.S. Pat. Nos. 6,298,580, 6,381,755, 6,393,620 and Patent Publication 2002/0121030 A1 and 2006/0254085 A1.

In U.S. Pat. No. 6,298,580 pedicure sandals are disclosed in which a sandal has a toe dividing portion that can be deployed from within the sole surface and is engageable between the user's toe separating them for manicure access thereto.

U.S. Pat. No. 6,381,755 a notched toe panty hose and use method is illustrated in which panty hose have a shallow notch formed in the toe portion to accommodate the thong strap of a sandal providing a claimed smooth and more comfortable contour.

U.S. Pat. No. 6,393,620 claims a partial sock configuration that will cover just the front portion of the user's foot which enhances the fit and comfort of the wearer's shoes. A retainment strap extends around the heel folding the sock in place during use.

Patent Publication 2002/0121030 A1 a thong footwear cushion is disclosed having a cylindrical shaped cushion with a longitudinal split therein. The cushion's outer surface is decorated and has adhesive strips to secure the cushion in place around the thong strap of a sandal.

A thong sandal accessory is shown in U.S. Patent Publication 2006/0254085 A1 which allows the wearer to change the color and look of the strap by an ornamental elongated overlay fabric appliance to the strap portion of the sandal.

SUMMARY OF THE INVENTION

A toe comfort insert for women's sandals that cushions the engagement of the sandal's thong strap between the wearer's toes. The comfort insert provides a non-invasive, low profile cushion to be secured partially around the thong strap and on the surrounding surface of the sandal. The insert has tapered sole engagement surface portion with defining angularly disposed upstanding semi-conical strap engagement portion for between the toes engagement with adhesive contact surface engageable on the sandal.

DETAILED DESCRIPTION OF THE INVENTION

Figure 1:
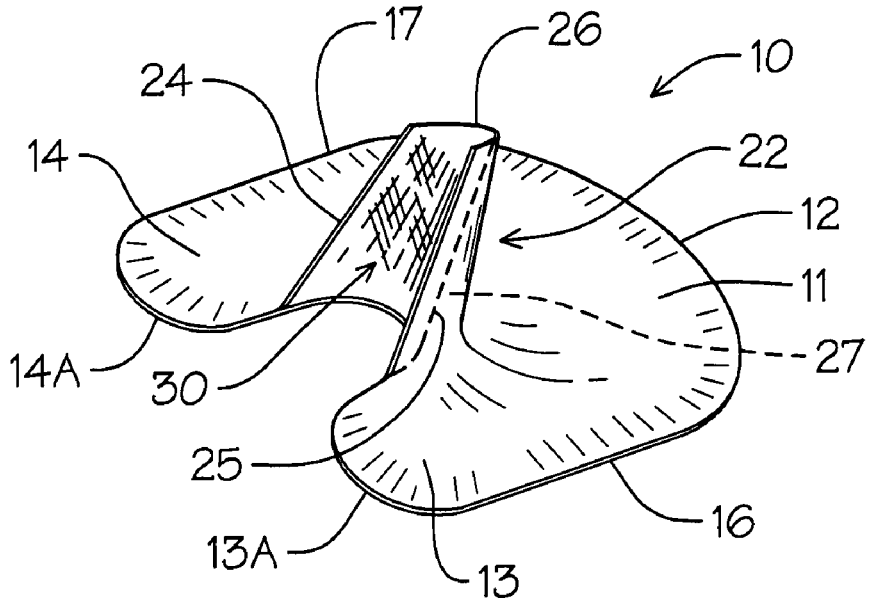
FIG. 1 is a perspective top, side and front view of the toe pad of the invention.
Figure 2:
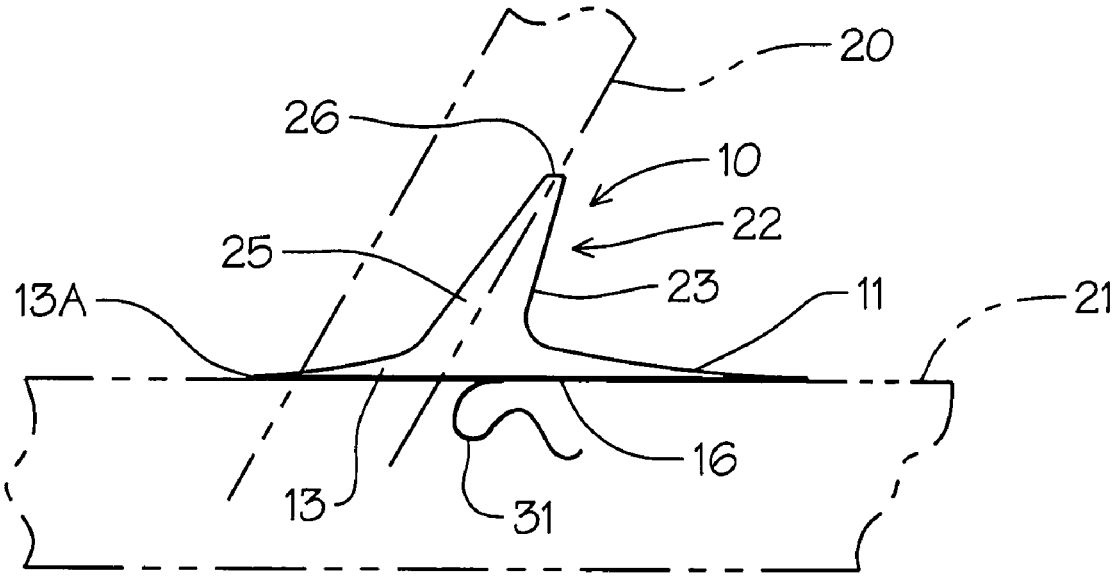
FIG. 2 is an enlarged side elevational view thereof on the footwear shown in broken lines.
Figure 3:
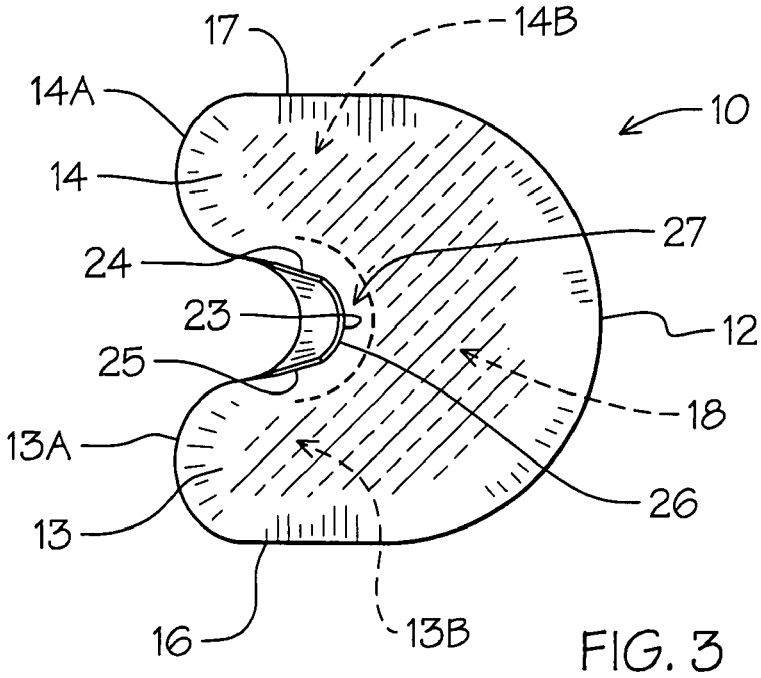
FIG. 3 is an enlarged top plan view of the toe pad of the invention.

Referring to FIGS. 1-3 of the drawings, a toe pad 10 of the invention can be seen having a generally flat base member 11, a curved back edge 12 with bifurcated oppositely disposed front portions 13 and 14. Each of the front portions 13 and 14 have identical arcuate end edges 13A and 14A with an increasing dimensional cushioned area 13B and 14B inwardly therefrom as indicated by the broken shaded lines there across, as best seen in FIG. 3 of the drawings.

The front portions 13 and 14 define respective oppositely disposed side edges 16 and 17 extending and transitioning into the curved back front edge 12. It will be seen that the cushion areas 13B and 14B extend inwardly from and along the side edges 16 and 17 merging to form a continuous cushion surface area at 18 thereacross with the tapered curvilinear termination surface area along the back edge 12.

The hereinbefore described cushion surface areas 13B, 14B, and 18 and corresponding perimeter tapered edges 12, 16 and 17 provide for a comfort transition for the user foot (not shown) eliminating potential distinctive edge termination while providing cushion comfort areas around a thong strap 20 extending from a sole 21, in broken lines, of a sandal (not shown) when applied thereto as will be described in greater detail hereinafter.

An upstanding thong strap engagement portion 22 of the toe pad 10 of the invention extends upwardly from between the back portions 13 and 14 in a partial fusto conical fashion defining a back arcuate wall surface 23 with oppositely disposed co-lateral sidewall surface extensions 24 and 25 emanating therefrom, best seen in FIGS. 1 and 3 of the drawings. The side surface extensions 24 and 25 are tapered from the integral intersections with the base portions 13 and 14 inner facing edges 13C and 14C terminating at an upper antiguous edge 26.

Figure 4:
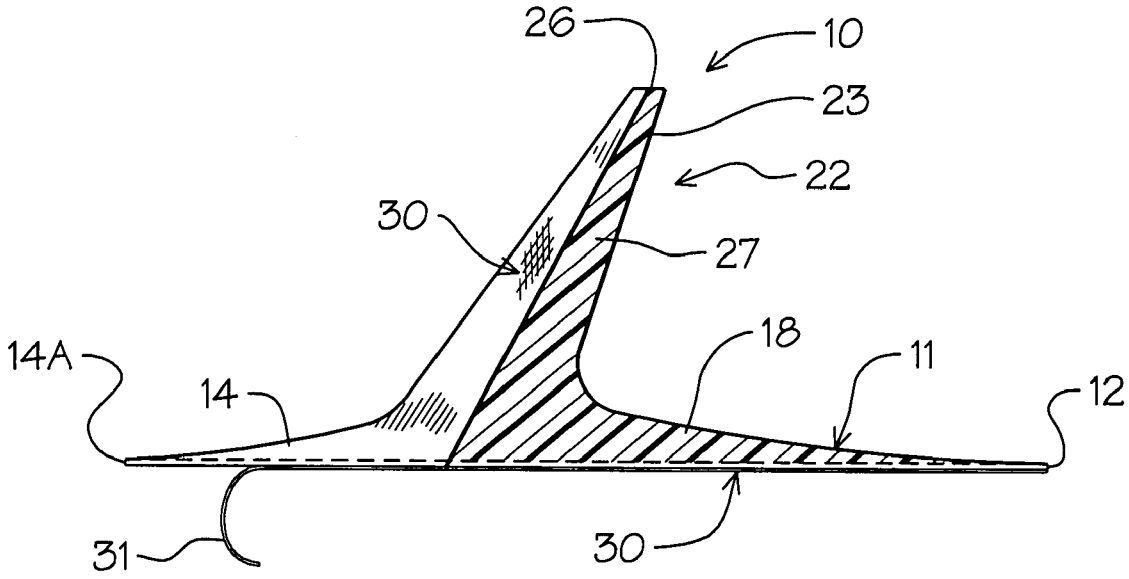
FIG. 4 is an enlarged cross-section on lines 4-4 of FIG. 3.

Referring now to FIG. 4 of the drawings, the relative thickness of the cushion areas 13B, 14B and 18 can be seen as well as a cushion area 27 of the thong strap engagement portion 22 that wraps around the back arcuate edge surface 23 and respective side surface extensions 24 and 25 illustrated by sectional and overlying broken lines respectively. It will therefore be seen that toe engagement area of the thong strap 20 extending from the sandal's sole 21 will be cushioned thereabout in a proportional specific contact relationship. Both a lower sandal sole engagement surface of the base portion 11 and inner engagement surface of the upstanding engagement portion 21 of the toe pad 10 as hereinbefore described have a pressure sensitive adhesive contact coating 30 with corresponding release sheets 31 for selective removal and application thereof to assure a properly positioned and applied toe pad of the invention to a sandal for use.

While a variety of accessible and functional materials may be used for the toe pad 10 of the invention, preferably synthetic resin based components would be used to provide for durability, ease of manufacture and ease of replacement.

It will therefore be seen that a new and novel self-adhesive toe pad for open toed sandals has been illustrated and described and it will be apparent to those skilled in the art that various changes and modifications may be made thereto without departing from the spirit of the invention.

We claim:

1. A toe pad apparatus for selective attachment to the thong and adjacent portion of open toe footwear comprising, a base and a self-supporting molded upstanding thong strap engagement portion, said base having spaced parallel bifurcated front portions extending therefrom, cushion areas of increased material thickness on said front portions and said remaining base portion, said upstanding thong strap engagement portion comprising, an arcuate back wall surface with a pair of co-lateral sidewall surfaces extending therefrom, said sidewalls and back wall surfaces having cushion areas of increased material thickness therein, an adhesive coating on said toe pad for selectively securing said toe pad to said thong and sole engagement surfaces.

2. The toe pad apparatus set forth in claim 1 wherein said base portion has tapered upper surfaces defined by said cushion areas of increased material thickness extending inwardly from its perimeter edges.

3. The toe pad apparatus set forth in claim 1 wherein said upstanding sidewall surfaces are conical from said base defining an upper continuous edge of reduced fixed translateral arcuate dimension.

4. The toe pad apparatus set forth in claim 1 wherein said toe pad apparatus is preferably made of a composite synthetic cushion and fabric material.

* * * * *